US007708674B1

(12) United States Patent
Saunders

(10) Patent No.: US 7,708,674 B1
(45) Date of Patent: May 4, 2010

(54) ARCHERY EXERCISER

(75) Inventor: Charles Saunders, Columbus, OH (US)

(73) Assignee: Saunders Archery Company, Columbus, NE (US)

( * ) Notice: Subject to any disclaimer, the term of this patent is extended or adjusted under 35 U.S.C. 154(b) by 508 days.

(21) Appl. No.: 11/334,253

(22) Filed: Jan. 17, 2006

Related U.S. Application Data

(60) Provisional application No. 60/645,565, filed on Jan. 19, 2005.

(51) Int. Cl.
*A63B 21/02* (2006.01)
*A63B 21/05* (2006.01)

(52) U.S. Cl. ..... 482/122; 124/1; 482/126; 482/128

(58) Field of Classification Search ..... 124/1; 482/44, 122, 126, 128, 121
See application file for complete search history.

(56) References Cited

U.S. PATENT DOCUMENTS 799,270 A * 9/1905 Roland ..... 482/97
3,784,195 A * 1/1974 Johnson ..... 482/123
4,351,527 A * 9/1982 Crisp, Jr. ..... 482/122
4,623,146 A * 11/1986 Jackson ..... 482/126
5,643,160 A * 7/1997 Huang ..... 482/126
6,402,667 B1 * 6/2002 Dahn ..... 482/121
2004/0224827 A1 * 11/2004 Ashley ..... 482/122

* cited by examiner

*Primary Examiner*—John Ricci
(74) *Attorney, Agent, or Firm*—Levenfeld Pearlstein, LLC

(57) ABSTRACT

The present invention provides for in one embodiment an archery exerciser training device designed to eliminate or minimize target panic, develop muscle memory, and warn up muscles before using a bow and arrow. The training device consists of a cylindrical tube with an attached handle. Within the tube is a gas compression spring with integrated plungers mounted on either end. Each plunger further includes an axle on which two wheels are opposingly mounted. A cable is mounted to one plunger at the distal end of the device and the cable travels in a zig-zag fashion around the four wheels and out of the plunger at the proximal end of the device and terminates in a loop, thereby creating a pulley system. The exposed loop of the cable is pulled in a rearward direction, approximating the motions made when drawing a bowstring. When the exposed loop is pulled, the distal plunger is forced rearward, thereby compressing the gas spring and creating an opposing force approximately equal to a typical draw weight of a bowstring. When the cable is released, the gas spring extends, pushing the distal plunger forward, and pulling the exposed cable back within the cylindrical tube in a safe and controlled manner. The process may be repeated over and over as necessary to sufficiently develop and train the archer's shooting muscles, and to warm up the muscles prior to shooting.

20 Claims, 5 Drawing Sheets

ARCHERY EXERCISER

CROSS-REFERENCE TO RELATED APPLICATIONS

This application claims the benefit of U.S. Provisional Application 60/645,565 filed Jan. 19, 2005.

FIELD OF THE INVENTION

The present invention relates generally to the field of archery and, more particularly, to an archery exerciser training device designed to minimize or eliminate target panic, develop muscle memory, and warm up muscles before using a bow and arrow.

BACKGROUND OF THE INVENTION

It is well known in the art that virtually all archers suffer from a condition known as "target panic." Target panic is an involuntary, psychological condition which commonly results in the premature release of an arrow, or at least a strong desire to do so. Target panic also often prevents an archer from holding the bow site on target or bow steady while aiming at a target because the archer may fear missing the target, is anticipating the release of the arrow or is too focused on establishing proper shooting posture and positioning and, therefore, is unable to accurately aim. Developing appropriate "muscle memory" can reduce or eliminate the undesirable effects of target panic, and can take the archer's mind away from pulling the trigger. Therefore, it is important for archers to regularly practice to train the muscles involved in the shooting process. Such training preferably should be accomplished without the fear of throwing an actual arrow.

Various prior art devices exist to help archers develop proper shooting muscle control and memory. Previously such devices simply comprised a pair of grips connected by an elastic cord, such as the device disclosed in U.S. Pat. No. 4,609,191, issued Sep. 2, 1986 to Remme. Later devices built on this basic idea and included various contraptions that attached to a bow or bowstring, such as the devices disclosed in U.S. Pat. No. 5,052,365, issued Oct. 1, 1991 to Carella, and U.S. Pat. No. 5,163,413 issued Nov. 17, 1992 to Carella. Other devices, such as the archery training aid disclosed in U.S. Pat. No. 4,741,320 issued May 3, 1988 to Wiard, incorporate electronic components intended to visually alert an archer when a full bowstring draw has been accomplished. However, most prior art devices currently on the market are long, bulky mechanism which either attach to the bow or have their own handles. Such devices are not easily transported or stowed, and many do not offer the ability to adjust the bowstring draw length.

BRIEF SUMMARY OF THE INVENTION

The present invention is an archery exerciser training device which permits an archer to develop and train the muscles involved in using a bow and arrow. The device consists of a cylindrical tube with an attached handle. Within the cylindrical tube is a gas spring with integrated plungers mounted on either end. Each plunger further includes an axle on which two wheels are opposingly mounted. The plunger at the proximal end of the device is fixedly mounted to the tube, while the plunger at the distal end of the device is permitted to slidably move within the tube. A cable is mounted to one plunger at the distal end of the device, and the cable travels in a zigzag fashion around the four wheels and out of the plunger at the proximal end of the device, thereby creating a pulley-type system. The exposed end of the cable is formed into a loop.

An archer wishing to use the device to practice, grips the handle with the same hand used to grip a bow. The archer then fully extends his or her arm so the device is positioned generally perpendicularly to the archer's body. With the archer's other hand (the hand used to draw the bowstring), the archer grabs the exposed loop of the cable (alternatively, any of a number of prior art, or future-developed, arrow release aids may be used in place of directly grabbing the loop) and pulls in a rearward direction, mimicking and approximating the motions made when drawing a bowstring. When the exposed cable is pulled, the distal plunger is forced rearward, thereby compressing the gas spring and creating an opposing force approximately equal to the draw weight of a bowstring. When the string is released, the gas spring extends, pushing the distal plunger forward and pulling the exposed cable back within the cylindrical tube in a safe and controlled manner, without whipping the cable. The process may be repeated over and over as necessary to sufficiently develop and train the archer's shooting muscles, and to warm up said muscles prior to shooting.

In another embodiment of the present invention, there is provided an archery exerciser that allows one to overcome or minimize target panic and muscle flinch associated with the release of an arrow. In another embodiment of the invention, there is provided an archery exerciser that trains an archer's shooting muscles by repetitive motion to create and enhance muscle memory. In another embodiment of the invention, there is provided an archery exerciser that is extremely transportable and easily stowed. In yet another embodiment of present invention, there is provided an archery exerciser that may be used to warm up an archer's shooting muscles prior to shooting. In another embodiment of the invention, there is provided an archery exerciser that may be used independently from an archery bow. In yet another embodiment of the present invention, there is provided an archery exerciser that works both with release aids and with an archer's fingers. In another embodiment of the present invention, there is provided an archery exerciser that saves wear on dealer's bows or an archer's bow by avoiding dry firing or accidentally releasing the bow string when no arrow is knocked. In yet another embodiment of the present invention, there is provided an archery exerciser that provides a constant draw weight with the draw weight able to be varied by using different or adjustable gas springs, pulley designs, and/or pressure, tension, or compression devices.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
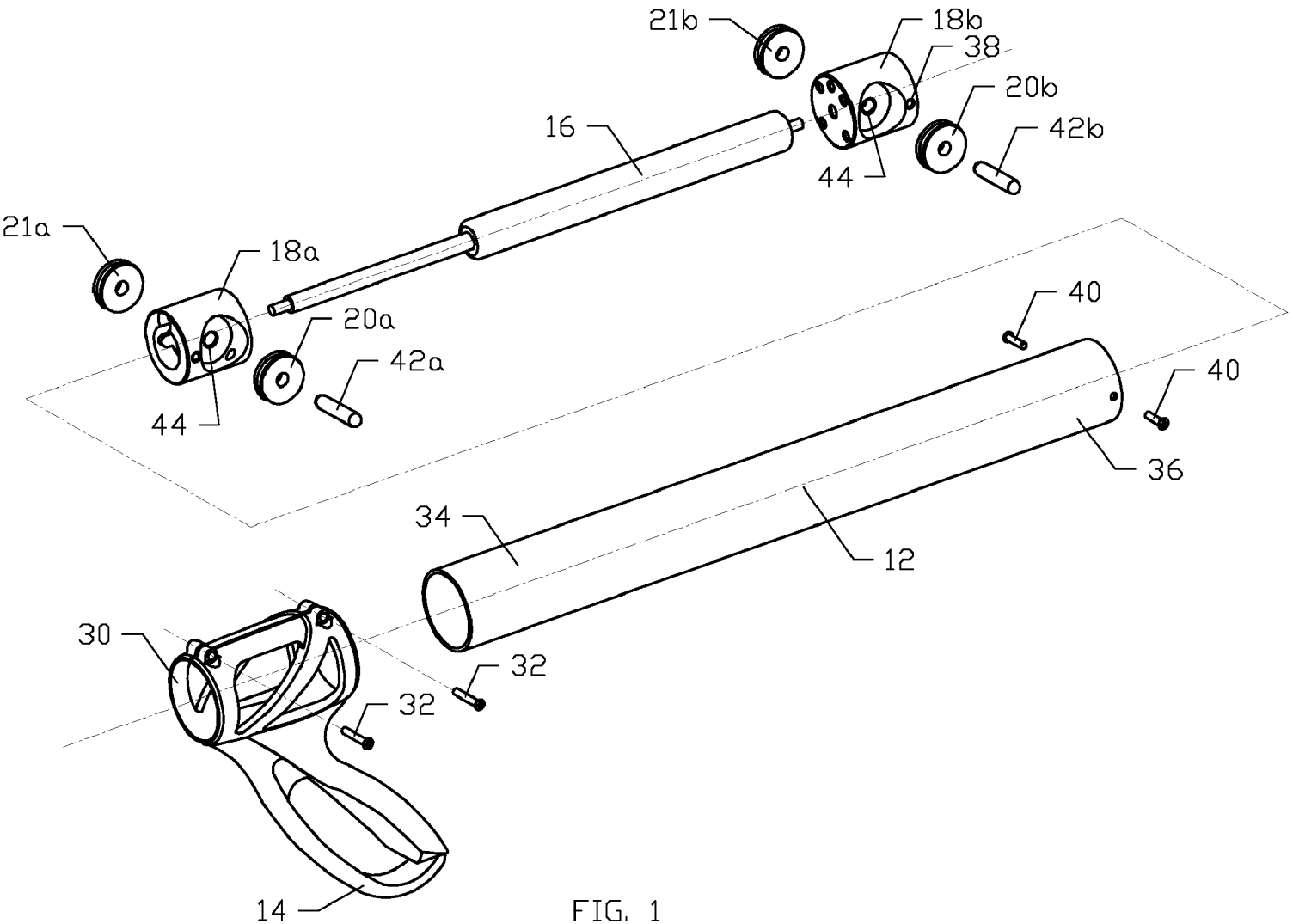
FIG. 1 is an exploded view of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
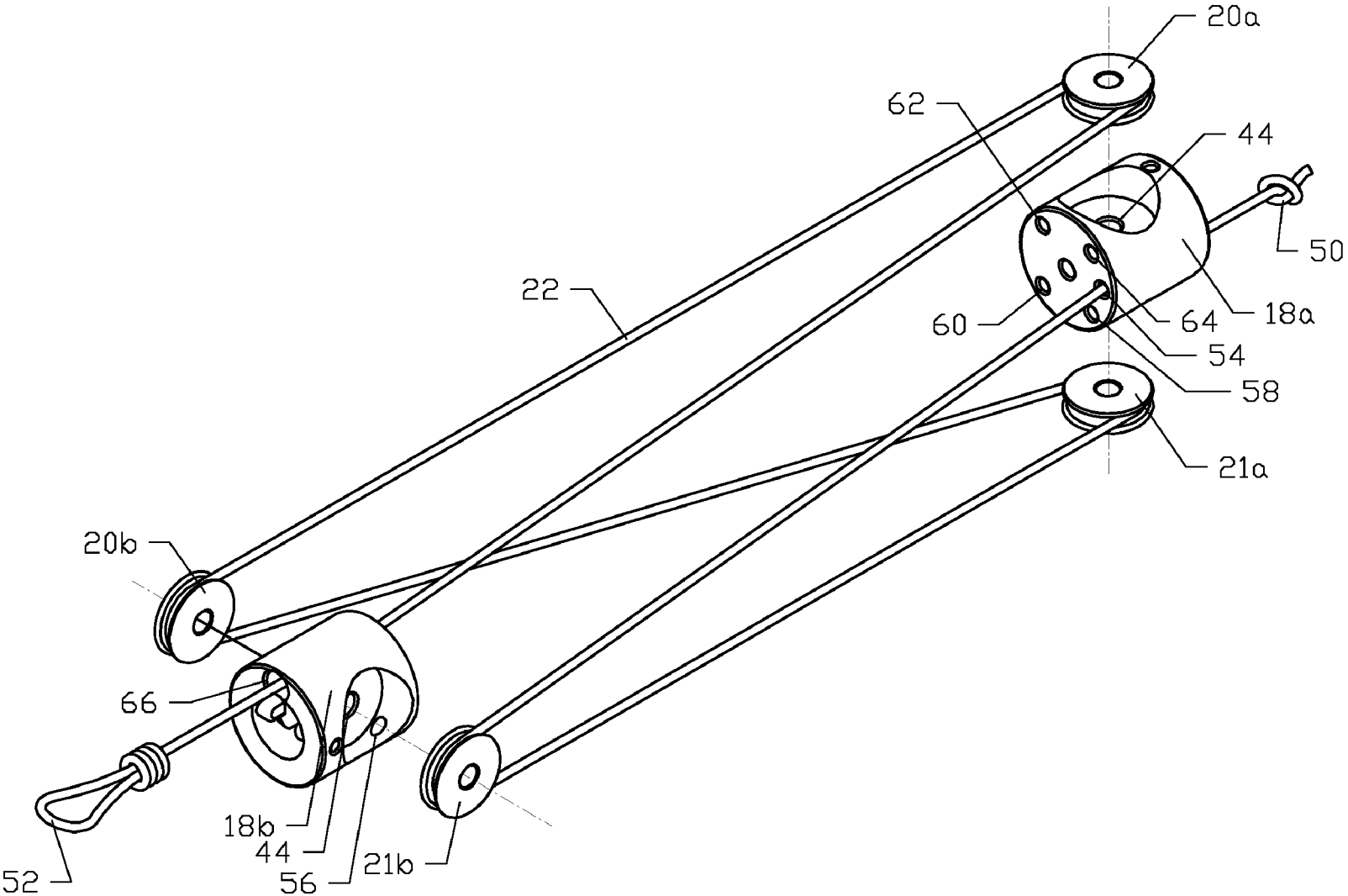
FIG. 2 is an exploded view of the cable and zig-zag configuration of the cable within the tube.
Figure 3:
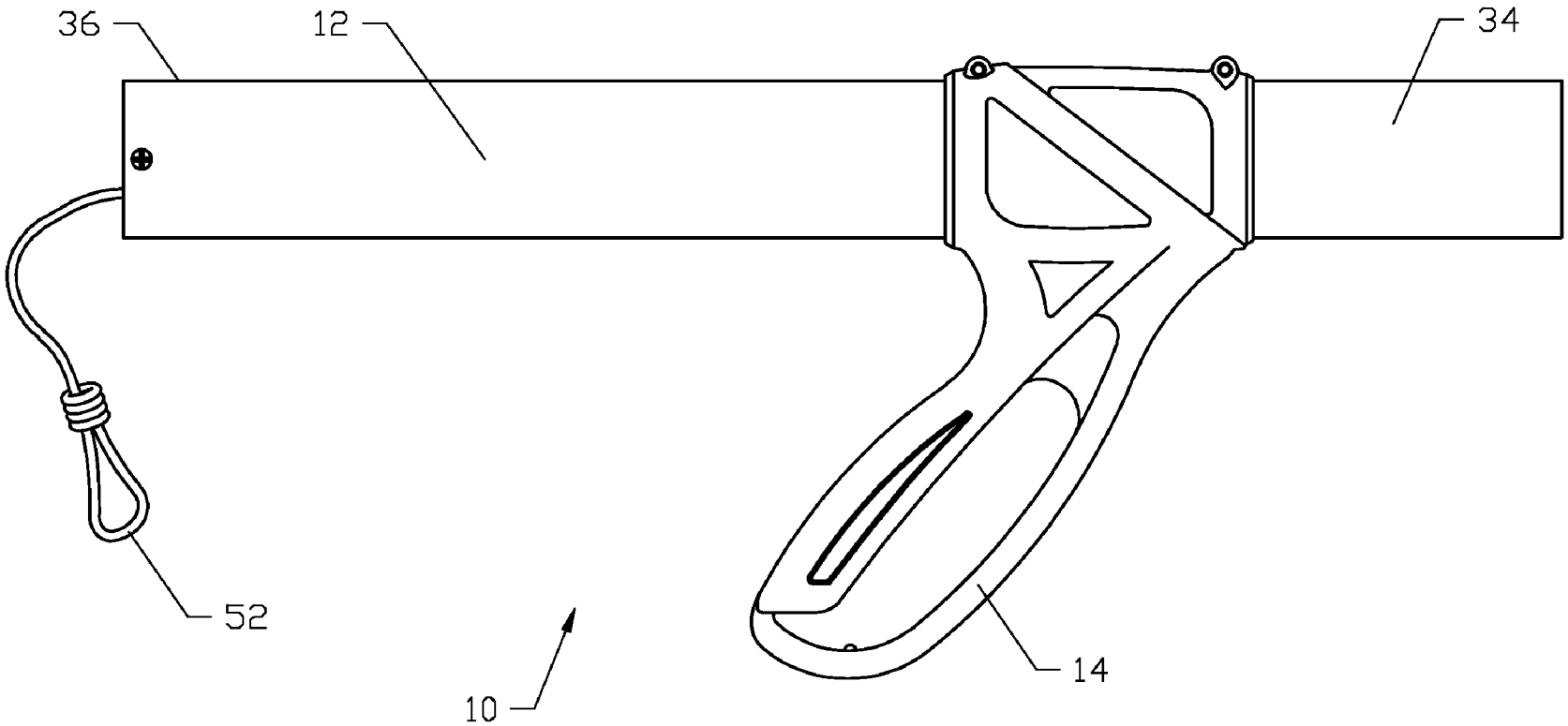
FIG. 3 is a side view of the present invention.

As shown in FIGS. 1, 2 and 3, the archery exerciser 10 of the present invention comprises six primary components: a cylindrical tube 12, a molded handle 14 attached to the tube, a gas spring 16, a pair of plungers 18*a* and 18*b* attached to the gas spring 16, a pair of wheels attached to each plunger, and a length of cable 22 fed across the wheels 20 to create a pulley-type system. It should be known that the term cable is used to cover all types of ropes, stings, wires, or archery bows, or other items such that may be substituted and used herein.

The cylindrical tube 12 is preferably manufactured from nylon, or another lightweight, sturdy material. The handle 14 is designed to mount over the outside of the tube 12 using a frictional clamp 30 that tightens and/or releases with tightening screws 32. The handle 14 is mounted on the tube 12 towards the distal end 34, the end furthest away from a user, to approximate the location of a bow handle.

Within the tube 12 is a gas spring 16. The gas spring 16 is of the type commonly found in the prior art and generally operates in a piston-like manner. On each end of the gas spring 16 is a plunger 18*a* and 18*b* that is mounted thereto. A first plunger 18*a* is mounted to the distal end 34 and a second plunger 18*b* is mounted to the proximal end 36. The first and second plungers 18*a* and 18*b* are generally cylindrical in shape and have a diameter slightly less than the inner diameter of the tube 12 to permit the plungers 18*a* and 18*b* to fit within the tube 12. And the size further permits the first plunger 18*a* to slide freely within the tube 12 along the central longitudinal axis of the tube 12. The second plunger 18*b* is fixedly mounted at the proximal end 36 of the tube using screws 40 that pass through the tube 12 and into mating threaded bores 38 on the second plunger 18*b*. Integrally mounted within each of the plungers 18*a* and 18*b* are a pair of wheels rotatably mounted on an axle running through a bore through the plungers. The wheels 20*a* and 21*a* mounted on axle 42*a* within the first plunger 18*a* and the wheels 20*b* and 21*b* mount on axle 42*b* within the second plunger 18*b*. Recessed apertures 44 on each plunger are provided to accommodate the wheels.

The cable should be of sufficient strength to be able to support the resistive forces created by the gas spring 16 during compression thereof. In the preferred embodiment of the present invention, this force is approximately 30 pounds. However, in alternate embodiments, different gas springs may be used which result in different resistive forces. Additional, in other embodiments of the present invention, the gas spring 16 may be replaced by other types of pressure, compression, and/or tension devices which provide similar levels of resistive force.

At one end of the cable 22 a knot, crimp or other fastening 50 is provided, while at the other end of the cable a loop 52 is formed. The cable 22 is positioned within the tube 12 to create a pulley-type system using the wheels 20*a*, 21*a*, 20*b*, 21*b* of the plungers 18*a* and 18*b*. To accomplish this, the cable 22 is fed through bores in the plungers 18*a* and 18*b* in the following manner. The fastening 50 is positioned at the distal end of the first plunger 18*a*. The cable 22 feeds through a bore 54 in the first plunger 18*a* and passes along the gas spring 16. The cable 22 passes around wheel 21*b* in the second plunger 18*b* through a bore 56 in the second plunger 18*b*. The cable 22 then exits the first plunger 18*a* through another bore (not shown) and travels along the gas spring 16 back towards the first plunger 18*a*. The cable 22 enters the first plunger 18*a* through bore 58 and passes around wheel 21*a* and exits the first plunger 18*a* through bore 60. Next, the cable 22 travels back towards the second plunger 18*b* and enters through a bore (not shown) and travels around wheel 20*b*. The cable 22 will exit the second plunger 18*b* through a bore (not shown) and travel back towards the first plunger 18*a*. The cable 22 enters the first plunger 18*a* through a bore 62, travels around wheel 20*a*, exits the first plunger 18*a* through a bore 64 and travels back towards the second plunger 18*b*. Lastly, the cable 22 enters the second plunger 18*b* via a bore (not shown) and exists the second plunger 18*b* through a hole 66, were the loop 52 is left exposed on the outside of the tube 12.

It should be noted that the cable 22 should be in excess of five times the length of the tube 12 in the preferred embodiment to permit the cable 22 to travel back and forth between the two plungers while the gas spring 16 is extended, to provide sufficient draw length. Further, the length of the cable 22 can be altered to provide different draw lengths as required by the user. Alternatively, the handle 14 can be moved along the length of the tube in order to adjust the draw length.

Lastly, as FIG. 2 illustrates the cable around the wheels but not entering specific bores in the plungers this was done for exemplary purposes only. And the description provided herein is the preferred manner of weaving the cable through the plungers.

In operation, a user of the device grips the handle 14 with the same hand used to grip a bow. The user fully extends his or her arm so that the tube 12 is positioned generally perpendicularly to the user's body. With the user's other hand (the hand used to draw the bowstring), the user grabs the loop 52 of the cable 22 (alternatively any of a number of prior art, or future-developed, arrow release aids may be used in place of directly grabbing the loop 52) and pulls the cable 22 in a rearward direction, relative to the user, thereby mimicking and approximating the motion of the drawing a bowstring. When the loop 52 is pulled, the first plunger 18*a* is forced rearward, relative to the user, thereby compressing the gas spring 16 and creating an opposing force approximately equal to the draw weight of a bowstring, approximately 30 pounds in the preferred embodiment. When the loop 52 is released, the gas spring 16 extends, pushing the first plunger 18*a* forward and pulling the cable 22 back within the tube 12 in a safe and controlled manner. The process may be repeated over and over as necessary to sufficiently develop and train the user's shooting muscles, and to warm up the muscles prior to shooting.

Figure 4:
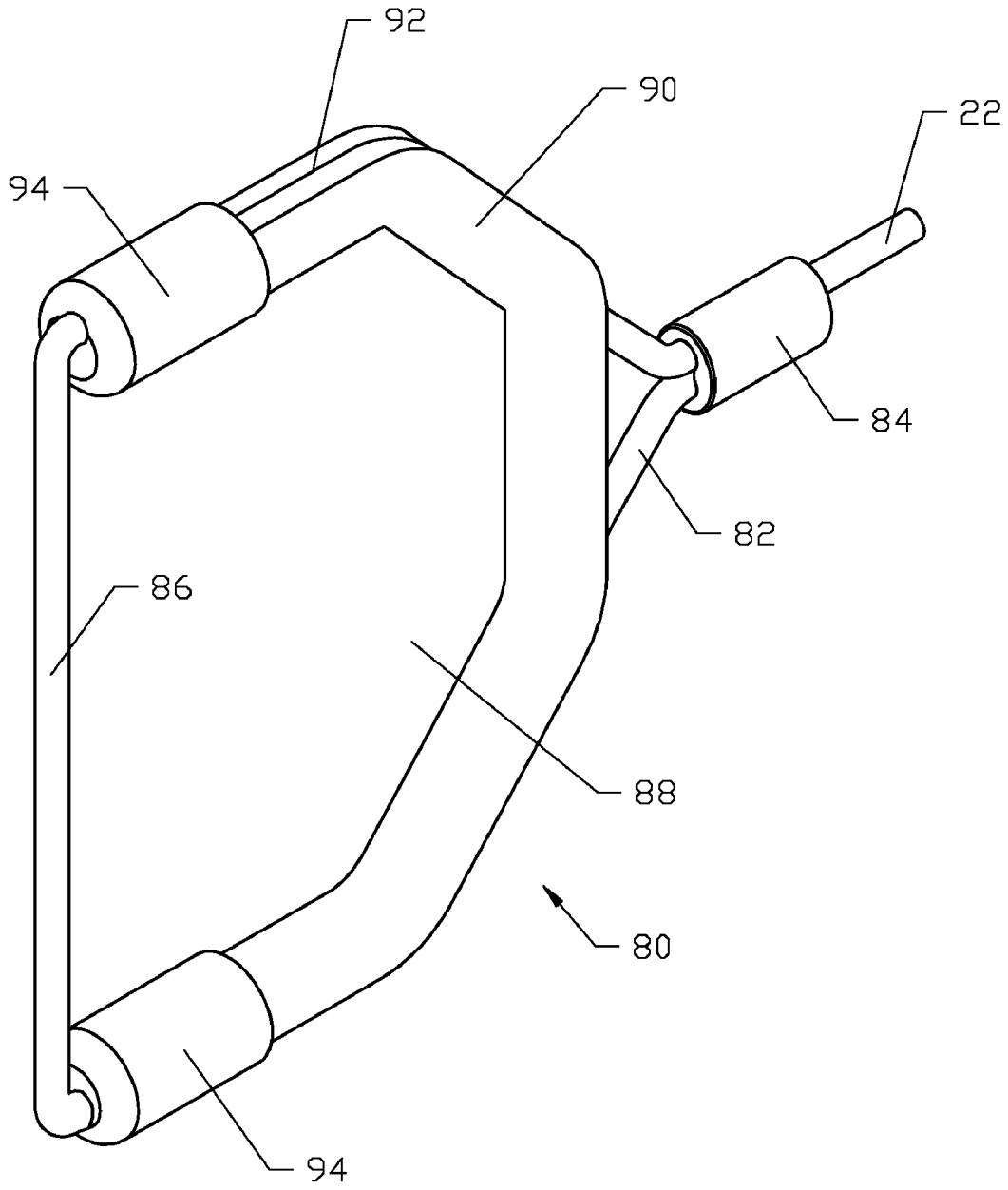
FIG. 4 is an enlarged view of an alternative loop region for the cable.
Figure 5:
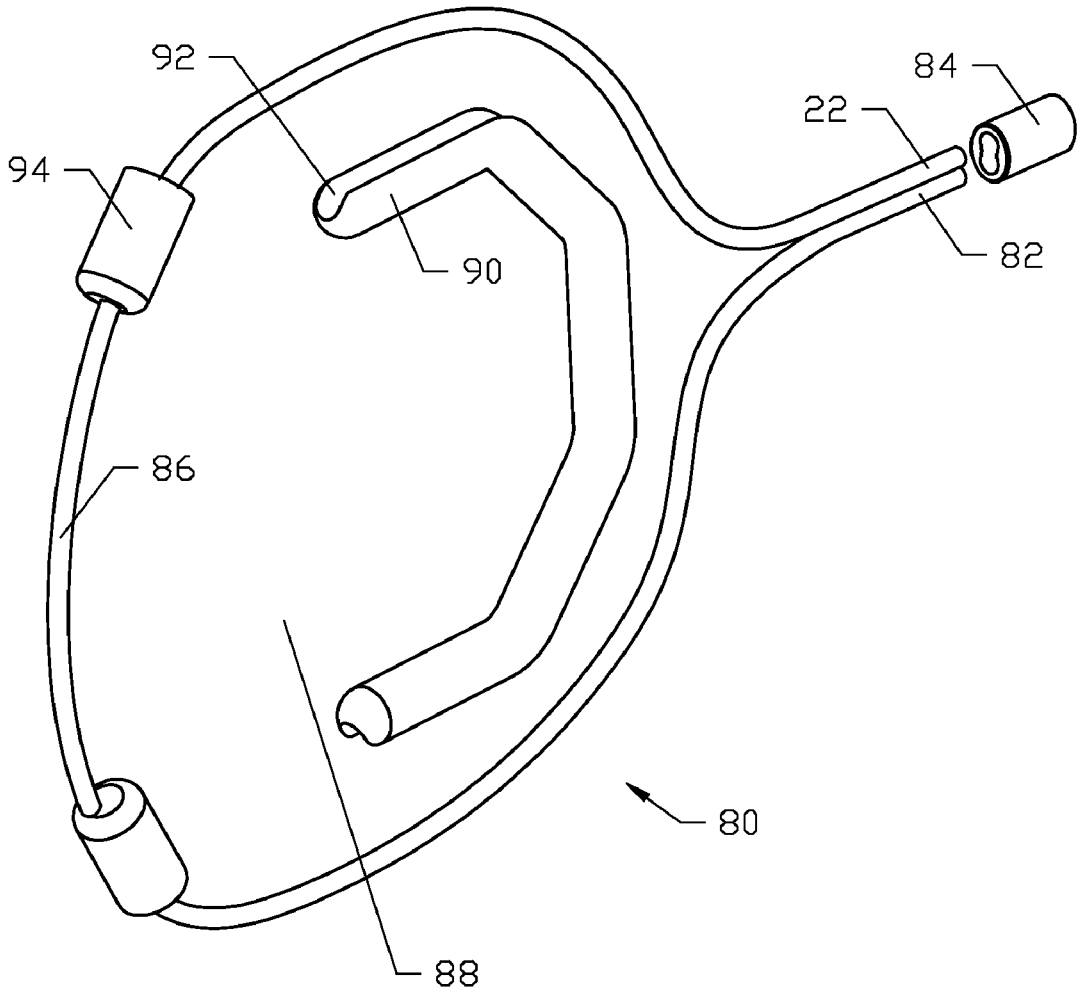
FIG. 5 is an exploded view of FIG. 4.

Referring now to FIGS. 4 and 5, there is shown an alternate loop region 80. The loop region 80 is created by having an end 82 of the cable 22 circulate back around itself to a crimping or fastening region 84 region. The cable 22 has a substantially straight section 86 suspended over the opening 88 defined by the loop 80. The suspension is caused by laying the cable 22 within a channel 92 defined in a bridge section 90. The ends of the bridge section 90 may include closed fastened members 94 to ensure the cable 22 does not separate from the bridge section 90. The substantially straight section 86 provides an area on the loop 80 for the user to attach arrow release aids.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

For example, it is envisioned that other embodiments of the present invention may use the same general internal mechanics, but forego the external cylindrical tube, with the pulley components directly mounted on the primary force-generating device. Additionally, it is contemplated that many other types of force generating devices and pulley designs may be used to achieve the same effect and to provide for desired variability in draw weight.

The invention claimed is:

1. An archery training aid comprising:

a cylindrical tube having proximal and distal ends and having a length from the proximal end to the distal end;

a handle attached to the distal end of the tube;

a compression spring having a pair of ends and being positioned within the tube such that the ends of the spring are substantially aligned with the proximal and distal ends of the tube;

first and second plungers separately mounted to the ends of the compression spring, wherein the first plunger slides within said tube and said second plunger is secured to the proximal end of the tube; and a flexible cable having a first end secured to the first plunger and a second end extending through the second plunger and out the proximal end of the tube, the cable having a length from the first end of the cable to the second end of the cable that is greater than the length of the tube, whereby a user is able to grasp the handle with one hand and grasp the second end of the cable and pull the cable out of the tube compressing the compression spring to provide an archery training aid.

2. The training aid of claim 1, wherein the handle includes an adjustment means such that the handle may be adjusted along the tube.

3. The training aid of claim 1, wherein each plunger includes a pair of wheels and the cable is wrapped alternatively around the wheels in a zig-zag manner to create a pulley system.

4. The training aid of claim 3, wherein each plunger includes a plurality of bores positioned and sized for the cable as it travels in the zig-zag manner between the two plungers and around the wheels.

5. The training aid of claim 1, wherein the second end of the cable has a loop.

6. The training aid of claim 5, wherein the loop has a substantially straight section suspended over an opening defined by the loop, the substantially straight section being created by laying the cable on a bridge section, and the bridge section having a C-shape such that the ends of the bridge section are maintained a predetermined distance apart to create the substantially straight section.

7. The training aid of claim 1, wherein the compression spring is a gas spring.

8. An archery training aid having a handle for a user to grasp, further comprising:

a compression spring having proximal and distal ends first and second plungers separately mounted to the ends of the compression spring, wherein the first plunger slides toward said second plunger; and a flexible cable having a first end secured to the first plunger and an unsecured second end extending through the second plunger and configured to be directly grasped by a user, the cable having a length measured between the first end of the cable and the second end of the cable that is more than twice as long as a distance between the first plunger and the second plunger when the compression spring is in a non-compressed state, whereby the user is able to grasp the handle with one hand and directly grasp the unsecured second end of the cable and pull the cable out compressing the compression spring to provide an archery training aid.

9. The training aid of claim 8 further comprising a cylindrical tube for receiving the compression spring, the tube having proximal and distal ends and wherein the first plunger slides within said tube and said second plunger is secured to the proximal end of the tube.

10. The training aid of claim 9, wherein the handle is adjustably attached to the tube.

11. The training aid of claim 8, wherein each plunger includes a pair of wheels and the cable is wrapped alternatively around the wheels in a zig-zag manner to create a pulley system.

12. The training aid of claim 11, wherein each plunger includes a plurality of bores positioned and sized for the cable as it travels in the zig-zag manner between the two plungers and around the wheels.

13. The training aid of claim 8, wherein the second end of the cable has a loop.

14. The training aid of claim 13, wherein the loop has a substantially straight section suspended over an opening defined by the loop, the substantially straight section being created by laying the cable on a bridge section.

15. An archery training aid comprising:

a cylindrical tube having proximal and distal ends and having a length from the proximal end to the distal end;

a handle attached to the distal end of the tube;

a tension device having a pair of ends and being positioned within the tube such that the ends of the tension device are aligned with the proximal and distal ends of the tube;

first and second plungers separately mounted to the ends of the tension device, wherein the first plunger slides within said tube and said second plunger is secured to the proximal end of the tube; and a flexible cable having a first end secured to the first plunger and a second end extending through the second plunger and out the proximal end of the tube, the cable having a length from the first end of the cable to the second end of the cable that is greater than the length of the tube, whereby a user is able to grasp the handle with one hand and grasp the second end of the cable and pull the cable out of the tube compression the tension device to provide an archery training aid.

16. The training aid of claim 15, wherein each plunger includes a pair of wheels and the cable is wrapped alternatively around the wheels in a zig-zag manner to create a pulley system.

17. The training aid of claim 16, wherein each plunger includes a plurality of bores positioned and sized for the cable as it travels in the zig-zag manner between the two plungers and around the wheels.

18. The training aid of claim 15, wherein the second end of the cable has a loop.

19. The training aid of claim 18, wherein the loop has a substantially straight section suspended over an opening defined by the loop, the substantially straight section being created by laying the cable on a bridge section which suspends the substantially straight section over said loop.

20. The training aid of claim 15, wherein the tension device is a compression spring.

* * * * *

UNITED STATES PATENT AND TRADEMARK OFFICE

CERTIFICATE OF CORRECTION

PATENT NO. : 7,708,674 B1
APPLICATION NO. : 11/334253
DATED : May 4, 2010
INVENTOR(S) : Charles Saunders It is certified that error appears in the above-identified patent and that said Letters Patent is hereby corrected as shown below:

Paragraph (57), Abstract: The word "warn" should be replaced with the word "warm," and the first sentence should read: "The present invention provides for in one embodiment an archery exerciser training device designed to eliminate or minimize target panic, develop muscle memory, and warm up muscles before using a bow and arrow."

Column 2, line 38: The word "knocked" should be replaced with the word "nocked" to read "...when no arrow is nocked. In yet..."

Column 3, line 11: The word "stings" should be replaced with the word "strings" to read "...all types of ropes, strings, wires, or archery bows..."

Column 3, lines 47-48: The word "Additional" should be replaced with the word "Additionally" to read "Additionally, in other embodiments..."

Column 4, lines 19-21: The word "as" should be deleted, and a ";" should be added to the sentence so that it reads "Lastly, FIG. 2 illustrates the cable around the wheels but not entering specific bores in the plungers; this was done for exemplary purposes only."

Column 4, line 48: The second word "region" should be deleted, and the line should read "...fastening region 84. The cable 22..."

Column 6, line 43 (Claim 15): The word "compression" should be replaced with the word "compressing," and the line should read "...of the tube compressing the tension device..."

Signed and Sealed this

Sixth Day of July, 2010

David J. Kappos

David J. Kappos
*Director of the United States Patent and Trademark Office*